United States Patent [19]

Berend et al.

[11] 4,012,854

[45] Mar. 22, 1977

[54] INFLATABLE SHOE

[76] Inventors: Steven P. Berend, 19 Pettit Drive, Dix Hills, N.Y. 11746; Carmelo Giardina, 48 Hathaway Road, Wilmington, Mass. 01887

[22] Filed: Feb. 17, 1976

[21] Appl. No.: 658,483

[52] U.S. Cl. ..... 36/29

[51] Int. Cl.[2] ..... A43B 13/20

[58] Field of Search ..... 36/29, 25 R

[56] References Cited

UNITED STATES PATENTS

| | | | |
|---|---|---|---|
| 586,155 | 7/1897 | Bascom | 36/29 |
| 1,653,059 | 12/1927 | Nelson | 36/29 |
| 2,020,240 | 11/1935 | Cochran | 36/29 X |
| 2,599,740 | 6/1952 | Bereridge | 36/25 R X |

FOREIGN PATENTS OR APPLICATIONS

| | | | |
|---|---|---|---|
| 925,961 | 4/1947 | France | 36/29 |
| 1,007,060 | 2/1952 | France | 36/29 |
| 16,240 | 1893 | United Kingdom | 36/29 |

*Primary Examiner*—Alfred R. Guest
*Attorney, Agent, or Firm*—Bauer, Amer & King

[57] ABSTRACT

The present invention discloses an inflatable shoe wherein the bottom surface of the sole is substantially flat from the area of the heel to the metatarsal region and turns upwardly in the portion thereof that is forward of the metatarsal region and an inflatable air chamber is located under the arch portion for support thereof and is positioned intermediate the heel portion and the metatarsal region of the shoe.

20 Claims, 5 Drawing Figures

INFLATABLE SHOE

BACKGROUND OF THE INVENTION

This invention relates generally to shoes. More particularly, the present invention relates to a shoe having a novel sole configuration.

It is well known that, by the use of proper shoes, the likelihood of incurring injuries to the lower torso is minimized. In addition, where there is a pre-existing physical disability in the lower torso, pain associated therewith can be minimized by wearing proper shoes and, in particular, shoes that provide a cushioning action when the wearer is either standing or walking. There have been many attempts made to devise a shoe which will resiliently support the wearer. However, much of the prior art has been unsatisfactory either because the resilient support was not properly located or because the shoes were inordinately expensive and were therefore impractical.

One example of the prior art is disclsoed in U.S. Pat. No. 2,020,240 granted on Nov. 5, 1935, to H. Cochran wherein there is disclosed a shoe having a substantially flat bottom sole and an inner sole that is spaced therefrom by means of an air chamber that extends throughout the length of the shoe from heel to the toe. In the Cochran patent, the bottom sole of the shoe is flat from the heel to the toe so that the weight of the wearer is improperly and unnaturally distributed. Construction as exemplified by the Cochran patent is likely to make walking difficult and may cause muscle fatigue and possibly damage due to the unnatural distribution of the wearer's weight. The air chamber also extends from the front or toe of the shoe to the heel and, therefore, does not localize the cushioning effect to the most sensitive portion that is directly beneath the wearer's arch.

Another example of the prior art is disclosed in U.S. Pat. No. 2,682,712 which was granted on Jul. 6, 1954 to P. Owsen et al. A shoe having an inflated sole and heel is disclosed in the Owsen patent. That is, an air chamber extends from the heel to the toe. In addition, the bottom sole disclosed in the Owsen et al patent is completely flat for the entire lenght of the shoe thereby causing an unnatural attitude to be assumed by the wearer. Because the air chamber in the Owsen et al patent is not limited to the area directly beneath the wearer's arch, maximum cushioning benefit cannot be derived.

U.S. Pat. No. 3,120,712 granted on Feb. 11, 1964, to L. Menken discloses still another form of prior art in the general field to which the present invention is directed. The Menken patent exemplifies an air chamber provided between inner and outer soles with the air chamber extending from a location closely adjacent the toe of the shoe and extending rearwardly to the raised heel as distinguished from the substantially flat sole of the present invention.

Still another U.S. Pat. No. 580,501 granted on Apr. 13, 1897, to E. Mobberly discloses a shoe construction wherein an air chamber that is provided between inner and outer soles extends from the toe protion rearwardly to the heel. The Mobberly construction, like that of the previously discussed patents, suffers from the effects of a raised heel that is intended to be compensated for by an air chamber extending over the entire length of the shoe.

Much the same is taught in U.S. Pat. No. 508,034 granted on Nov. 7, 1893, to F. Moore where there is disclosed a shoe having a raised heel and forward air chamber that extends approximately from the arch portion of the shoe to the toe. In addition, a second air chamber is provided rearwardly of the arch and extends over the heel portion of the shoe. It will be appreciated that the air chambers in the Moore patent are positioned fore and aft of the arch portion of the wearer while the raised heel leaves the wearer's arch portion essentially free of walking contact with the ground.

Other variations of those constructions exemplified by the aforementioned patents are disclosed in the following U.S. Pat. to:

Butterfield No. 259,092; Bascom No. 586,155; Harrison, Jr. No. 1,498,838; Manelas No. 1,639,381; Richmond et al No. 3,871,117.

SUMMARY

The present invention provides a substantially flat sole for walking support of the arch and a discrete air chamber that is positioned between the heel and the metatarsal regions of the shoe and is located directly below and in direct support of the arch of the wearer. The shoe comprising the present invention may either be hand formed or molded. If it is molded, polyurethane or any other comparable mold material, which is common in the practice of the manufacture of shoes, may be employed. The sole is provided with a solid toe area and a substantially solid heel area. As used herein, the term "solid" is used to denote the absence of an inflatable structure, for example, a bladder. However, the term "solid" does not delimit the invention and is intended to include a yieldable and/or cellular type material in which air may be entrained or trapped.

In the present invention, the portion between the heel and the toe of the shoe is hollow to include, specifically the arch portion of the sole. The hollow portion forms the inflatable part or section of the sole. The inflatable or hollow portion may include a separate bladder of the inflatable type if desired.

In the manufacture of the shoe according to the present invention, the sole is provided with a laterally extending flange or lip that projects beyond and outward from the main portion of the sole in order to provide an area for stitching or securing means by which the remaining portions of the shoe may be attached to the sole.

In one embodiment of the present invention the shoe upper and the mid-sole are manufactured together as a unit prior to their being joined to the bottom sole of the shoe. However, in practice, it may be possible to secure the mid-sole directly to the bottom sole of the shoe and thereafter the upper of the shoe may be secured to both the mid-sole and the bottom sole. In a specific embodiment of the present invention, the mid-sole and the upper are secured together prior to their assembly to the bottom sole. The mid-sole and the upper are stitched or otherwise secured such as by means of adhesive to the flange of the bottom sole in order to enclose the hollow area of the lower sole that defines a fluid-tight air chamber.

Valve means are added to the shoe, for example, in the bottom sole, in order to enable the inflation of the hollow portion thereof. If a bladder is added to the hollow portion, the valve is connected to the bladder for selective inflation thereof.

One aspect of the present invention provides a novel shoe having an upper that includes an integral mid-sole. A bottom sole is then secured to the mid-sole with the bottom sole being substantially flat over the bottom surface thereof in the area between the heel and the metatarsal region of the shoe. The portion of the bottom sole extending forward of the metatarsal region curves and extends upwardly. An air chamber, which may be defined by a recess in the bottom sole, is located beneath the mid-sole and is positioned intermediate the heel portion and the metatarsal region of the shoe and specifically beneath the arch of the wearer.

In another aspect of the present invention, there is provided an inflatable shoe that comprises, in combination, an upper and a bottom sole sealed to the upper with an air chamber being defined therebetween. The air chamber is positioned intermediate the heel and the metatarsal portion of the shoe and directly beneath the arch of the wearer. Means are also provided for inflating the air chamber.

In still another aspect of the present invention an improved shoe is provided which includes an upper to which is secured sole means that are substantially flat over the bottom surface thereof between the heel and the metatarsal region of the shoe. The sole means extend upwardly over the bottom surface thereof that is forward of the metatarsal region of the shoe.

It is, therefore, an object of the present invention to provide an improved shoe construction.

It is another object of the present invention to provide an improved shoe having a sole that is substantially flat over the area extending from the heel of the shoe to the metatarsal region and which extends upwardly in the area forward of the metatarsal region.

It is a further object of the present invention to provide an improved shoe having an air chamber therein.

It is yet another object of the present invention to provide an improved shoe, as described above, wherein the air chamber is located directly beneath the arch of the wearer.

It is a still further object of the present invention to provide an improved shoe, as described above, wherein a bottom sole is secured to a mid-sole that is integral with the upper and wherein an air chamber is positioned intermediate the heel portion of the metatarsal region of the shoe and wherein the bottom sole is substantially flat between the heel and the metatarsal region of the shoe.

The above description, as well as further objects, features and advantages of the present invention, will be more fully appreciated by reference to the following detailed description of a presently preferred, but nonetheless illustrative embodiment in accordance with the present invention when taken in conjunction with the accompanying drawings.

BRIEF DESCRIPTION OF THE DRAWINGS

In the drawings, wherein the same reference numeral denotes the same element throughout the several views.

DETAILED DESCRIPTION OF THE INVENTION

Figure 1:
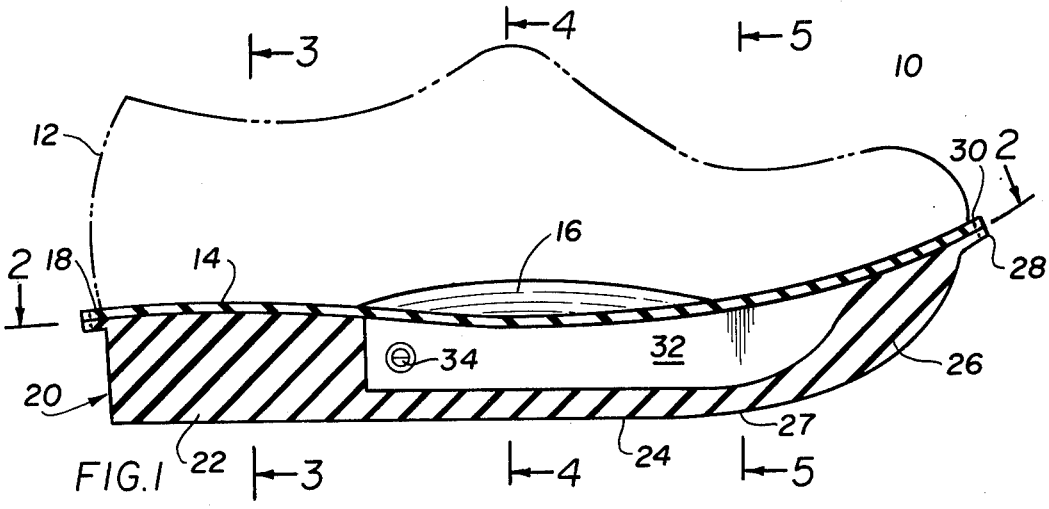
FIG. 1 is a longitudinal sectional elevational view of the shoe comprising the present invention.
Figure 2:
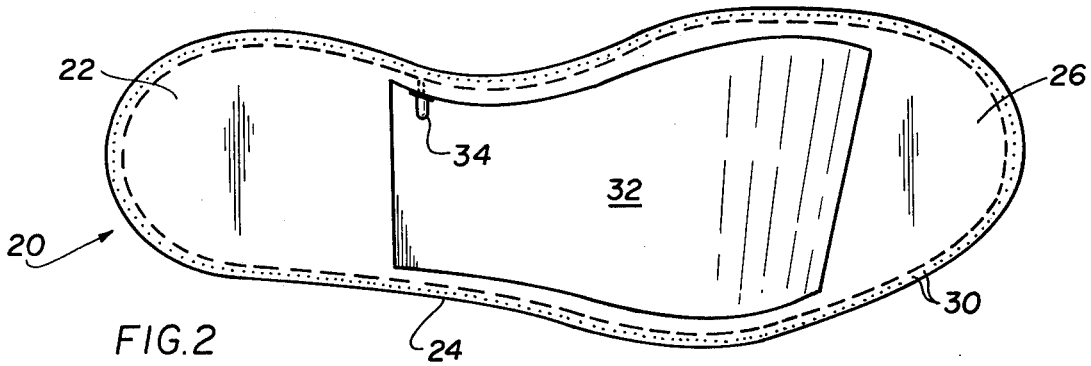
FIG. 2. is a plan view taken along lines 2—2 of FIG. 1.
Figure 3:
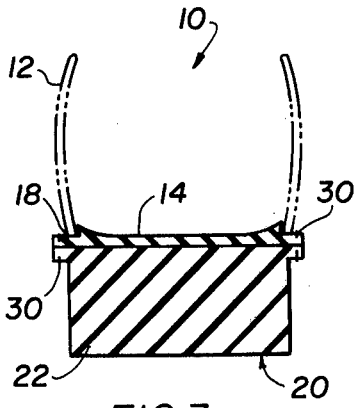
FIG. 3. is a transverse sectional elevational view taken along lines 3—3 of FIG. 1.

Referring now to the drawings and particularly to FIGS. 1 and 2, there is shown a novel shoe generally identified by the numeral 10 comprising the present invention. The shoe 10 includes an upper 12 to which is secured, in a conventional manner, a mid-sole 14. An arch 16 is formed on the mid-sole 14 as well as a peripheral lip or rim 18 proximate which the upper 12 is secured.

A bottom sole, generally designated by the reference character 20, is comprised of a heel end portion 22, a mid-section portion 24 and a toe end portion 26. The bottom sole 20 is also provided with a peripheral lip or rim 28 that mates with the peripheral lip or rim 18 of the mid-sole 14. Stitching 30 or suitable adhesive means may be used for joining the two lips or rims 18 and 28 of the mid-sole 14 and the bottom sole 20, respectively. It should be noted at this time that the bottom sole 20 is substantially flat over the area covered by the heel end portion 22 and the mid-portion 24 so that the flat bottom surface of the bottom sole 20 extends forward from the heel of the shoe to a position proximate the metatarsal region 27 of the shoe. Forwardly of the metatarsal region 27 of the shoe the bottom sole 20, in the vicinity of the toe end 26, extends upwardly and, preferably, is curved.

Figure 4:
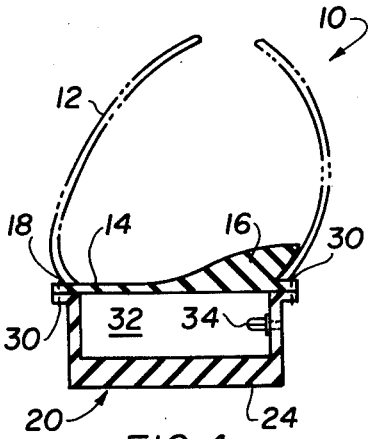
FIG. 4. is another transverse sectional elevational view taken along lines 4—4 of FIG. 1.
Figure 5:
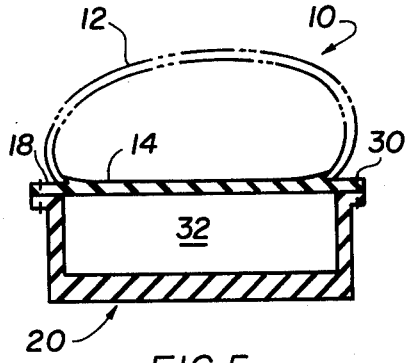
FIG. 5. is still another transverse sectional elevational view taken along lines 5—5 of FIG. 1.

The bottom sole 20 is provided with a recess to define an air chamber 32 in combination with the mid-sole 14. Valve means 34 which extend through the sidewall of the bottom sole 22 provides communication to the interior of the air chamber 32 so that air may be directed therein. As noted hereinabove, the air chamber 32 may be provided with a separate bladder and, in such an event, the valve means 34 would be in fluid communication with interior of the bladder. It should be particularly noted that the air chamber 32 extends from the heel end portion 22 to approximately the metatarsal region 27 of the shoe of the toe end portion 26 and, specifically, is located directly beneath the arch 16 as shown best in FIG. 1 and in FIG. 4.

From the foregoing it will be appreciated that an improved, novel shoe has been provided. The weight of the wearer is distributed uniformly from the heel end portion of the foot to the ball of the foot with cushioning being provided directly beneath the arch of the wearer by means of an inflatable chamber. In order to provide maximum comfort, the toe of the shoe is curved upwardly while the remaining or rearward portion of the bottom sole is flat.

The shoe comprising the present invention can be inexpensively manufactured since the upper 12 and the mid-sole 14 can be made integrally with each other with the bottom sole being secured thereto by stitching 30 or by the application of a suitable adhesive. Thus, the entire upper and mid-sole of the shoe may be manufactured prior to securing the bottom sole 20 thereon. This enables a quick and inexpensive method of manufacture.

Maximum comfort is achieved by placing the air chamber directly below the arch of the wearer to directly support the same flat thereat and by limiting the air chamber to that particular area as opposed to extending the same over the entire length of the shoe. The air chamber may be inflated by means of a valve and, if desired, a bladder that is in fluid communication with the valve may be placed in the recess that defines the air chamber. The mid-sole and the bottom sole are both provided with mating, laterally extending lips or rims so that they may be sealingly secured to each other by means of stitching or adhesive.

While there have been shown and described and pointed out the fundamental novel features of the invention as applied to a preferred embodiment thereof, it will be understood that various omissions and substitutions and changes in the form and details of the device illustrated may be made by those skilled in the art without departing from the spirit of the invention. It is the intention, therefore, to be limited only as indicated by the scope of the claims appended hereto.

What is claimed is:

1. A shoe comprising, in combination:

an upper having a mid-sole integral therewith;

a bottom sole secured to said mid-sole, said bottom sole being substantially flat over the bottom surface thereof that extends between the heel and the metatarsal region of said shoe, said bottom sole extending upwardly over the bottom surface thereof that is forward of the metatarsal region of said shoe;

and an air chamber located beneath said mid-sole, the extremities of said air chamber being positioned intermediate the heel portion and the metatarsal region of said shoe;

said mid-sole and said bottom sole each include marginal mating rims along which said mid-sole and said bottom sole are secured to each other;

said mid-sole and said bottom sole are secured to each other along said marginal, mating rims by at least one row of stitches.

2. The shoe according to claim 1 wherein valve means are included for introducing air into said air chamber.

3. The shoe according to claim 2 wherein said valve means are located on a peripheral side edge of said shoe.

4. The shoe according to claim 2 wherein said valve means are located on the lateral inside peripheral edge of said bottom sole.

5. Ths shoe according to claim 1 wherein said air chamber is defined by a recess in the upper surface of said bottom sole.

6. The shoe according to claim 5 wherein said recess extends approximately the entire width of said bottom sole.

7. The shoe according to claim 6 wherein said upwardly extending portion of said bottom sole is curved.

8. The shoe according to claim 1 wherein said mid-sole includes a raised arch portion that is directly above said air chamber.

9. An inflatable shoe comprising, in combination:

an upper including a mid-sole;

a bottom sole sealed to said mid-sole and defining therewith an air chamber intermediate the heel and metatarsal portion of said shoe;

and means for inflating said air chamber;

said bottom sole being substantially flat over the bottom surface thereof to extend between the heel and metatarsal region of said shoe, said bottom sole extending upwardly over the bottom surface thereof that is forward of the metatarsal region of said shoe.

10. The shoe according to claim 9 wherein said air chamber is further defined by a recess in said bottom sole.

11. The shoe according to claim 9 wherein the extremeties of said air chamber are positioned intermediate the heel portion and the metatarsal region of said shoe.

12. The shoe according to claim 9 wherein said upwardly extending portion of said bottom sole is curved.

13. The shoe according to claim 9 wherein said inflating means is a valve.

14. The shoe according to claim 13 wherein said valve is located on a peripheral side edge of said shoe.

15. The shoe according to claim 13 wherein said valve is located on the lateral inside peripheral edge of said bottom sole.

16. The shoe according to claim 9 wherein said bottom sole is secured to said mid-sole proximate the peripheral said edge thereof.

17. An improved shoe comprising, in combination:

an upper;

and sole means secured to said upper, said sole means being substantially flat over the bottom surface thereof extending between the heel and metatarsal region of said shoe, said sole means extending upwardly over the bottom surface thereof that is forward of the metatarsal region of said shoe;

said sole means includes an air chamber therein and means are included for introducing air into said air chamber and the extremeties of said air chamber are positioned intermediate the heel portion and the metatarsal region of said shoe.

18. The shoe according to claim 17 wherein said upwardly extending portion of said sole means is curved.

19. The shoe according to claim 17 wherein said sole means is secured to said upper along the peripheral side edge thereof.

20. The shoe according to claim 17 wherein said sole means includes a raised arch portion directly above said air chamber.

* * * * *

UNITED STATES PATENT OFFICE

CERTIFICATE OF CORRECTION

PATENT NO. : 4,012,854

DATED : March 22, 1977

INVENTOR(S) : STEVEN P. BEREND

It is certified that error appears in the above-identified patent and that said Letters Patent are hereby corrected as shown below:

IN THE CLAIMS:

Claim 5, line 1, change "Ths" to --The--

Claim 16, line 3, change "said" to --side--

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*